United States Patent [19]

Everett

[11] Patent Number: 4,835,503

[45] Date of Patent: May 30, 1989

[54] LINEAR PROPORTIONAL SOLENOID

[75] Inventor: William F. Everett, Goshen, Ind.

[73] Assignee: South Bend Controls, Inc., South Bend, Ind.

[21] Appl. No.: 841,599

[22] Filed: Mar. 20, 1986

[51] Int. Cl.[4] ..... H01F 7/08

[52] U.S. Cl. ..... 335/229; 335/230

[58] Field of Search ..... 335/229, 230, 234, 255

[56] References Cited

U.S. PATENT DOCUMENTS

| | | | |
|---|---|---|---|
| 3,202,886 | 8/1965 | Kramer et al. | 335/234 |
| 3,728,654 | 4/1973 | Tada | 335/234 |
| 3,775,714 | 11/1973 | Heuer | 335/230 |
| 4,127,835 | 11/1978 | Knutson | 335/266 |
| 4,164,721 | 8/1979 | Ishida et al. | 335/229 |
| 4,195,277 | 3/1980 | Leicht | 335/299 |
| 4,306,207 | 12/1981 | Tada et al. | 335/234 |
| 4,383,234 | 5/1983 | Yatsushiro et al. | 335/234 X |
| 4,419,643 | 12/1983 | Ojima et al. | 335/234 |
| 4,462,013 | 7/1984 | Ueda et al. | 335/234 X |
| 4,463,322 | 7/1984 | Everett | 335/258 |
| 4,525,695 | 6/1985 | Sheng et al. | 335/262 |

FOREIGN PATENT DOCUMENTS

| | | | |
|---|---|---|---|
| 1159099 | 12/1983 | Canada | 335/234 |

OTHER PUBLICATIONS

Application & Use of Rare Earth Magnets, M. F. Marx, G. E. Co., meeting No. 41, Palo Alto, CA.

*Primary Examiner*—George Harris

*Attorney, Agent, or Firm*—Barnes & Thornburg

[57] ABSTRACT

A solenoid device is provided having a permanent magnet mounted directly on the polepiece at the core gap to provide an initial magnetic flux through the polepiece and to focus the induced magnetic flux additionally supplied upon actuation of the solenoid. The magnetic flux through the polepiece continues across the core gap and into an armature which is supported by linear rate springs and spaced from the housing by side gaps. A coil device is mounted about the polepiece to provide induced magnetic flux in response to the applied electrical current input. The polepiece is adjustable within the housing to establish various core gap distances. The side and core gap dimensions within the magnetic flux circuit are proportioned relative to each other to maintain constant magnetic permeance about the circuit during solenoid actuation.

5 Claims, 2 Drawing Sheets

LINEAR PROPORTIONAL SOLENOID

BACKGROUND AND SUMMARY OF THE INVENTION

The present invention relates generally to rectilinear motion proportional solenoids and, more particularly, to such solenoids which produce an output force which is linearly proportional to the applied electric current input.

Specifically, the present invention provides a novel embodiment and improvement upon the invention disclosed in U.S. Pat. No. 4,463,332 which issued July 31, 1984 to the same inventor and assignee as the present invention. The complete disclosure and specification of that patent are incorporated herein by reference.

Further objects of the present invention include providing a proportional solenoid having decreased flux leakage out of the magnetic circuit.

Another object is to provide a proportional solenoid having higher magnetic permeance and a decreased housing size without loss of output force.

Still another object is the provision of a more efficient proportional solenoid of simplified construction.

These and other objects of the present invention are attained by the provision of a solenoid device having a permanent magnet mounted directly on the polepiece at the core gap to provide an initial magnetic flux through the polepiece and to focus the induced magnetic flux additionally supplied upon actuation of the solenoid. The magnetic flux through the polepiece continues across the core gap and into an armature which is supported by linear rate springs and spaced from the housing by side gaps. A coil device is mounted about the polepiece to provide induced magnetic flux in response to the applied electrical current input. The polepiece is adjustable within the housing to establish various core gap distances. The side and core gap dimensions within the magnetic flux circuit are proportioned relative to each other to maintain constant magnetic permeance about the circuit during soleoid actuation.

Other objects, advantages and novel features of the present invention will become readily apparent upon consideration of the following detailed description in conjunction with the drawings.

DETAILED DESCRIPTION OF THE PREFERRED EMBODIMENTS

Figure 1:
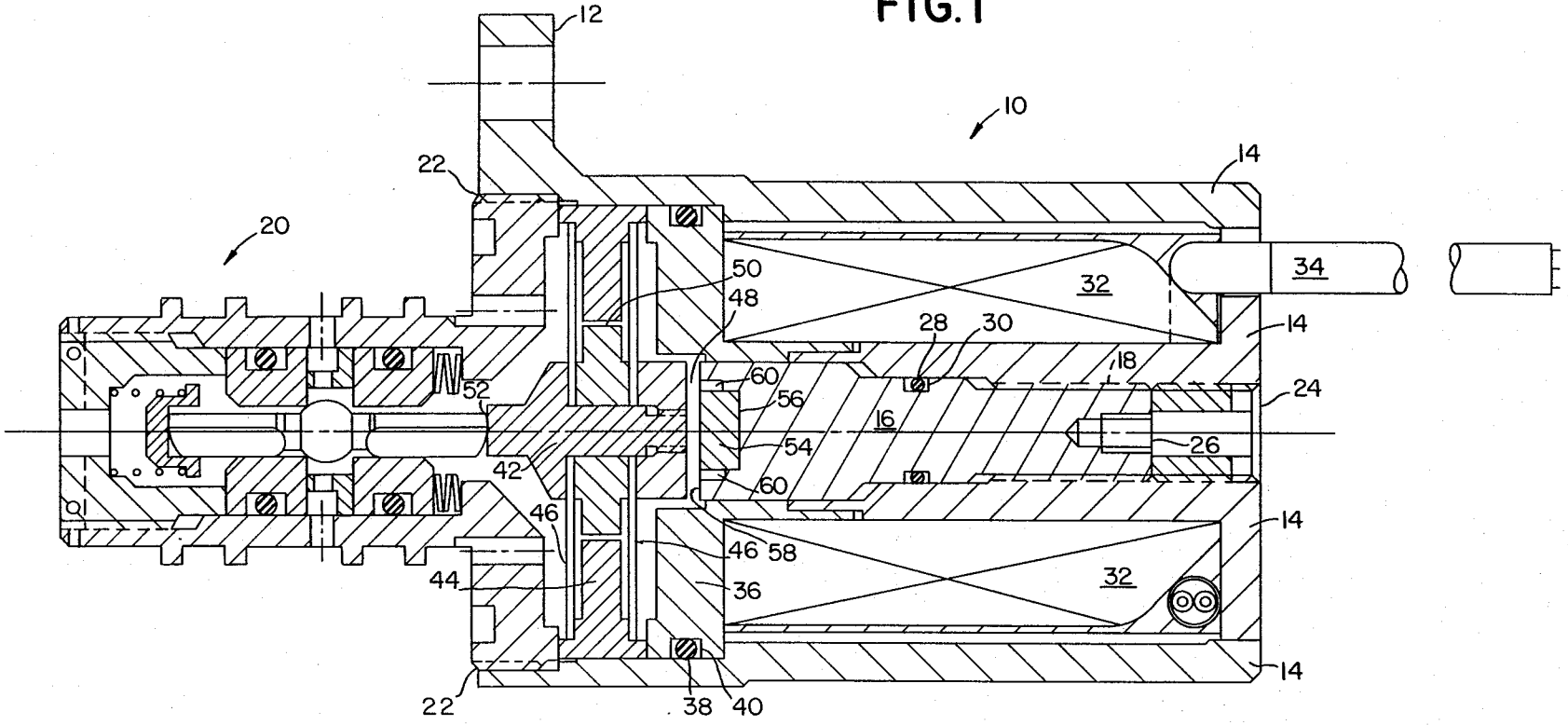
FIG. 1 shows a longitudinal, cross-sectional view of a preferred embodiment of the present invention.

FIG, 1, which illustrates a preferred embodiment of the present invention, shows an adjustable, rectilinear motion proportional solenoid 10 coupled with a valve device 20. Solenoid 10 is generally cylindrical and includes at least one mounting flange 12. Valve 20 illustrates an exemplary utilization of solenoid 10 and may be of conventional design. Valve 20 is, for example, threaded to solenoid 10 by threads 22. In this sense, FIG. 1 of the present application corresponds with FIG. 3 of U.S. Pat. No. 4,463,332.

Solenoid 10 includes housing 14 which encloses the internal solenoid components. Polepiece 16 is centrally located within housing 14 and is threadably adjustable in an axial direction with respect to the housing at 18 by insertion of a keyed tool (not shown) through rear opening 24 in housing 10 and into slot 26. O-ring 28 is disposed in recess 30 about polepiece 16 and provides a fluid-tight seal between housing 14 and the polepiece.

Electromagnetic coil 32 is disposed within housing 14 about polepiece 16. Coil 32 is connected to a source of electrical current (not shown) by wire leads 34. When current is applied to coil 32, magnetic flux is induced in polepiece 16, depending upon the amount of circuit. Core plate 36 encloses coil 32 within housing 14. O-ring 38 in recess 40 forms a fluid-tight seal between core plate 36 and housing 14.

Armature 42 is mounted to ring 44 by two flat, linear-rate springs 46. Ring 44 is mounted within housing 14 adjacent core plate 36. Armature 42 is spaced apart from polepiece 16 by the width of the core gap 48. Armature 42 is spaced apart from ring 44 by the width of side gap 50. Surface 52 of armature 42 provides the output force of the solenoid.

Permanent magnet 54 is mounted within recess 56 in polepiece 16 at core gap 48 and facing armature 42. In this configuration, the effective working area of the polepiece with respect to magnetic flux across the core gap is surface 58. Where, for example, permanent magnet 54 and polepiece 16 have a circular cross-sectional configuration, surface 58 has a torroidal cross-sectional configuration. Permanent magnet 54 is separated from polepiece 16 at surface 58 by side gaps 60.

As with the invention of the above-noted prior patent, polepiece 16 is constructed of a magnetic material and the permanent magnet creates an initial level of flux within the polepiece which causes it to "start" at a higher incremental permeability. In general, the present invention provides many of the same advantages and operating characteristics as the invention of U.S. Pat. No. 4,463,332. The side gap and core gap dimensions are similarly selected to provide constant magnetic permeance about the flux circuit. The polepiece is adjustable to establish predetermined core gap widths. Further, the armature is also mounted on linear rate springs so as to cause the force generated across the core gap to be a sole function of changing flux density through the polepiece.

However, the present invention distinguishes and improves upon that prior solenoid in several important aspects. The permanent magnet is mounted directly on the polepiece rather than as a ring about the coil and interrupting the flux circuit Thus, elements 40, 44, 46 and 48 of U.S. Pat. No. 4,463,332 are no longer necessary and considerable savings in space and weight are now available. The flux circuit flows simply from polepiece 16 through armature 42, ring 44 and housing 14. The output force from surface 52 is still a linear function of the current applied through leads 34 to coil 32.

Unlike in the prior patent, the permanent magnet does not interrupt the flux circuit. Since magnetic permeability is higher through the polepiece than through the permanent magnet, the overall circuit permeability is significantly higher. This provides improved solenoid performance since magnetic hysteresis is thereby decreased as well as less magnetizing force (in terms of Oersteds) is required to create a given flux.

Permanent magnet 54 is, for example, formed from rare earth materials and, therefore exerts a much stronger magnetic force, dispite its relatively small size, than prior Alnico magnets. Previously, it was not considered feasible to use rare earth magnets in such solenoids.

Further, since the magnet is mounted directly at the working gap, flux leakage out of the flux circuit has been found to be significantly less than with an annular ring magnet at the outside diameter of the coil.

Figure 2:
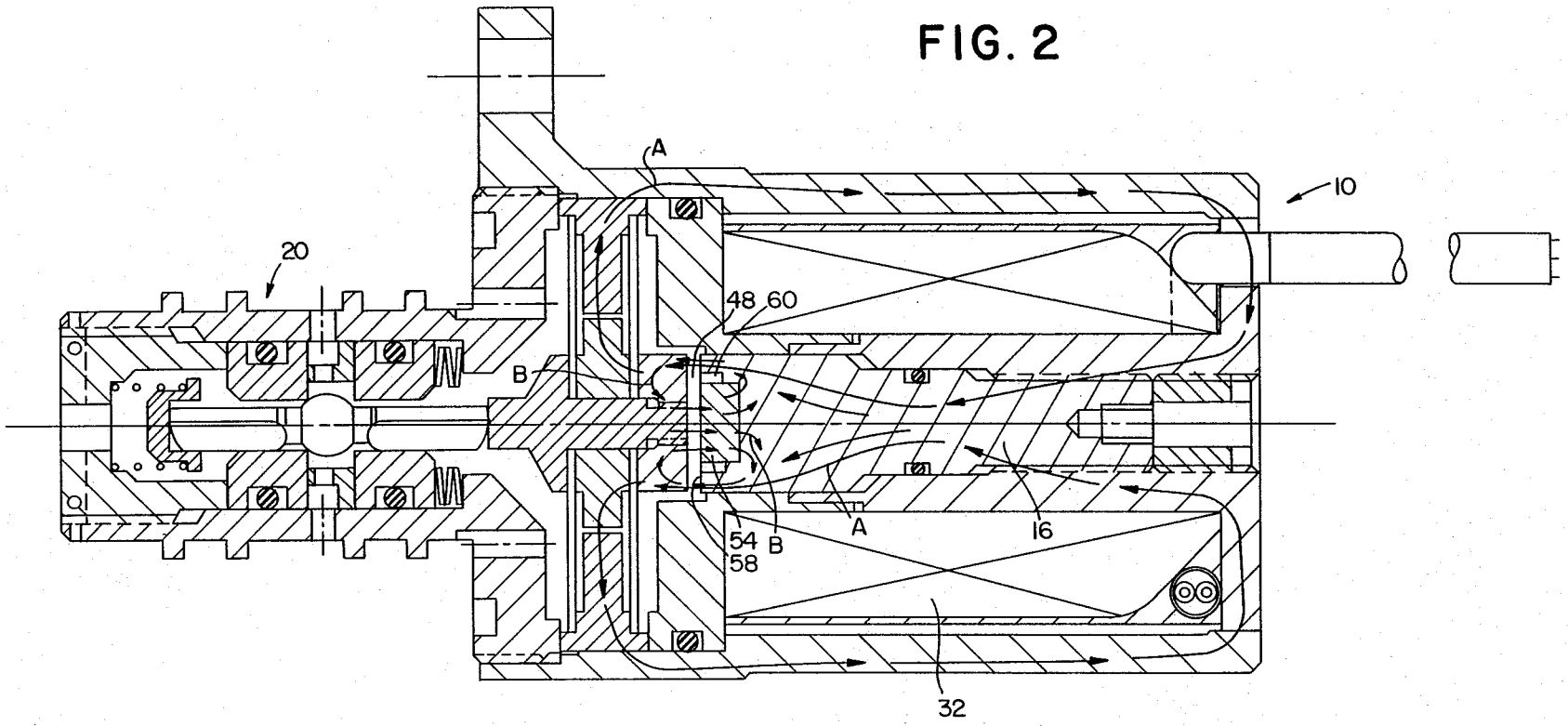
FIG. 2 shows a view of FIG. 1 with the flux lines during solenoid operation also illustrated.

FIG. 2 illustrates the flux circuit within the present invention during solenoid actuation. Electric current applied to coil 32 creates an induced magnetic field having flux lines A. The magnitude of this field is variable and changes with the amount of current input to coil 32. Permanent magnet 54 creates a further magnetic field within the polepiece and across core gap 48 having flux lines B. Magnet 54 is normally stationary during solenoid actuation, although it is axially adjustable with polepiece 16.

Because of the magnetic field orientation of magnet 54, flux lines B are added to flux lines A to create the magnetic force across core gap 48. Further, since the permeability of magnet 54 is relatively low and since the magnetic field generated by magnet 54 actually opposes and redirects the magnetic field generated by coil 32, lines of flux A are, in effect, focused by magnet 54 across surface 58 and core gap 48. As a result, the flux density out of polepiece 16 is increased into the linear range referred to in FIGS. 5 and 6 of U.S. Pat. No 4,463,332.

Depending upon the desired flux density in a particular application, the ratio of the area of surface 58 to the surface area of magnet 54 facing core gap 48 is controllable to any predetermined level. In many applications, it will be desirable to decrease the area of surface 58 until the flux density is in the linear range, but not so much as to saturate the polepiece at that point. Similarly, side gap 60 should be large enough to minimize flux leakage to magnet 54 and yet not significantly restrict flux across core gap 48.

Although the present invention has been described and illustrated above in detail, the same is by way of example only and is not to be taken as a limitation. The spirit and scope of the present invention are only limited by the terms of the claims defined below.

What is claimed is:

1. A solenoid device, wherein output motion is substantially linearly porportional to the input electrical current, comprising:

a housing;

a moveable armature assembly mounted within said housing;

a polepiece member mounted within said housing and normally spaced apart by a predetermined core gap from said armature assembly; coil means, mounted within said housing, for electromagnetically inducing magnetic flux through said polepiece, across said core gap and into said armature assembly as a result of said input electrical current;

permanent magnet means, mounted onto said polepiece, for establishing, an initial flux density within said polepiece and for focusing the magnetic flux through said polepiece induced by said coil means; and said polepiece including a face area through which said magnetic flux is focused across said core gap and into said armature and wherein said permanent magnet means is mounted onto said polepiece at said core gap and is spaced apart by side gaps from said face area.

2. The solenoid device according to claim 1 wherein the magnetic flux of said permanent magnet is additive with respect to the magnetic flux induced from said coil means across said core gap.

3. The solenoid device according to claim 2 wherein said permanent magnet means is formed from rare earth magnetic materials.

4. The solenoid device according to claim 3 further including means for maintaining constant magnetic permeance about the flux circuit through said housing during actuation of said solenoid device.

5. A solenoid device, wherein output motion is substantially linearly proportional to the input electrical current, comprising;

a housing;

a moveable armature assembly mounted within said housing;

a polepiece member mounted within the said housing and normally spaced apart by a predetermined core gap from said armature assembly;

coil means mounted within said housing, for electromagnetically inducing magnetic flux through said polepiece, across said core gap and into said armature assembly as a result of said input electrical current;

permanent magnet means mounted onto said polepiece, for establishing an initial flux density within said polepiece and for focusing the magnetic flux through said polepiece induced by said coil means; and said polepiece being constructed of a magnetic material and being adjustably disposed within said housing such that said core gap can be established at various predetermined distances.

* * * * *